United States Patent [19]

Kleiner

[11] 4,172,476

[45] Oct. 30, 1979

[54] READING ARRANGEMENT FOR A DOBBY

[75] Inventor: Walter Kleiner, Hirzel, Switzerland

[73] Assignee: Staeubli Ltd., Zurich, Switzerland

[21] Appl. No.: 813,356

[22] Filed: Jul. 6, 1977

[30] Foreign Application Priority Data

Jul. 8, 1976 [CH] Switzerland ..... 8753/76

[51] Int. Cl.[2] ..... D03C 1/22

[52] U.S. Cl. ..... 139/68; 139/331

[58] Field of Search ..... 139/59, 60 R, 66 A, 139/68, 317, 329, 330, 331; 66/50

[56] References Cited

U.S. PATENT DOCUMENTS

| | | | |
|---|---|---|---|
| 327,188 | 9/1885 | Mutter | 139/331 |
| 500,112 | 6/1893 | Buyck | 139/68 |
| 2,696,092 | 12/1954 | Miller | 139/331 |
| 3,060,975 | 10/1962 | Pfarrwaller | 139/68 |
| 3,665,972 | 5/1972 | Hoenig | 139/331 |
| 3,951,176 | 4/1976 | Koyama | 139/331 |

FOREIGN PATENT DOCUMENTS

| | | | |
|---|---|---|---|
| 237768 | 3/1945 | Switzerland | 139/68 |
| 391594 | 9/1965 | Switzerland | 139/68 |

*Primary Examiner*—Henry Jaudon

*Attorney, Agent, or Firm*—Blanchard, Flynn, Thiel, Boutell & Tanis

[57] ABSTRACT

A dobby with a mechanical reading device for a control card having perforated and nonperforated portions therein according to a pattern. The reading needle of the reading device of the pattern card has yielding elements for the purpose of reducing the impact force of the reading needle onto the pattern card.

12 Claims, 8 Drawing Figures

READING ARRANGEMENT FOR A DOBBY

FIELD OF THE INVENTION

The invention relates to a reading arrangement for a fast-running dobby having a reading needle of a mechanical reading device engaging the nonperforated or perforated portions of a pattern card.

BACKGROUND OF THE INVENTION

To control dobbies, pattern cards with nonperforated or perforated portions are used which are read by needles of a control mechanism. The movement of the reading needle toward the pattern card is done with the aid of gravity or in fast-running machines with pretensioned springs or special drive parts. Upon increasing the operating speed, the time which is available for reading is reduced. The reading needles are moved forwardly faster and hit with greater speed the nonperforated parts, and in time can result in fatique distortions in the pattern card, for example deformations and breakage of the nonperforated parts and eventually cause control errors.

By reinforcing the pattern card, a stiffening thereof would result and would make same heavier and bulky. The needle mass can be reduced only in as much as the durability of the needle is not affected. A direct and purposeful control of the movement of the needle leads to time losses during the course of the control operation and also causes vibrations in the needle.

The purpose of the invention is a simple structure of a reading device for a dobby which permits an increase in the operating speed thereof.

This is inventively achieved in a reading arrangement of the abovementioned type by providing an element which yields in axial direction of the reading needle and is arranged either on the reading needle or on the pattern card.

With this arrangement, the nonresilient mass portion of the reading needle which directly engages the card can be reduced by reducing the respective needle length to the movement requirements into the pattern card. The needle portion which is necessary for transmitting the reading result is movably connected in axial direction to a base part. The yielding effect can be assured by an elastic deformation or by relative movement against a frictional resistance and the latter can be applied as an additional arrangement parallel to the first one. It is important that the entire needle length is reduced when the needle strikes a nonperforated portion of the pattern card and that prior to the next following reading of the pattern card and during an indexing of the pattern card the original length is again achieved.

BRIEF DESCRIPTION OF THE DRAWINGS

Exemplary embodiments of the subject matter of the invention are illustrated in the drawings, in which.

DETAILED DESCRIPTION

Figure 8:
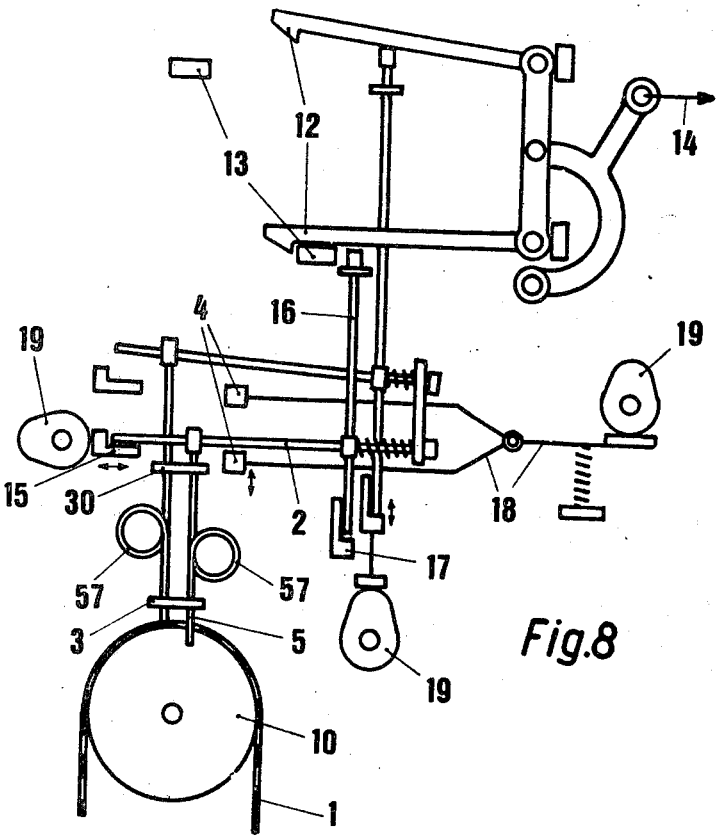
FIG. 8 is a schematic view of the principal structure of a reading-in mechanism of a dobby for controlling a weaving machine, as is discussed more in detail for example in U.S. Pat. No. 2,705,505 wherein an inventive spring element is built into the reading needle. This patent is assigned to the same assignee as is the present invention.

FIG. 8 illustrates a pattern card 1 which is moved by a cylinder 10. The pattern card has nonperforated and perforated portions for controlling a dobby of a Hattersley system. The two draw hooks which are associated with a frame of the weaving machine are identified by the reference numeral 12, which draw hooks are pulled out in a patterned manner by the draw knives 13. The schematically illustrated draw bar 14 provides the connection to the frame of the weaving machine.

Only the reading-in mechanism which is associated with the lower draw hook 12 will be described hereinafter. The reading needle 5 is loosely suspended by means of an eyelet on an auxiliary needle 2 which lies both in the radiused path of movement of a vertically movable rod 4 and the back and forth movement of a push bar 15. The support needle 16 is slidably supported in an eyelet of the auxiliary needle 2 and the lower end thereof rests on a vertically movable step bar 17.

The rod 4 is driven by a two-arm lever 18 which is controlled at one end by a rotatably supported cam member 19.

The push bar 15 is driven in the same manner by a rotatably supported cam member 19.

Figure 1:
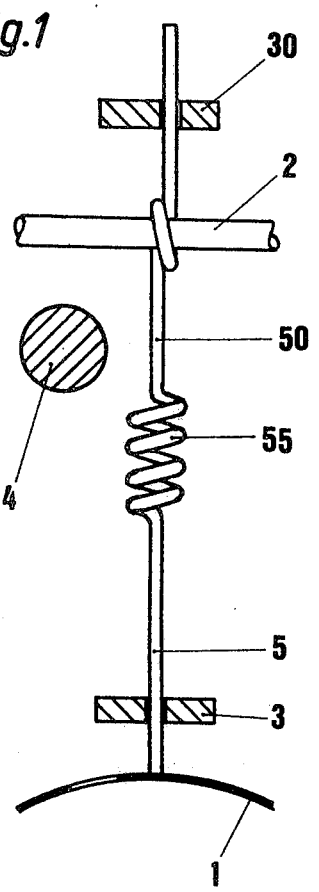
FIG. 1 illustrates a reading arrangement having a reading needle with a built-in helical spring during a reading of a nonperforated portion of a pattern card.

The reading needle illustrated in FIG. 1 consists of an upper needle part 50 would around the auxiliary needle 2 and a lower needle part 5 which for reading the pattern card 1 directly cooperates therewith. The auxiliary needle 2 and needle 5,50 are lifted vertically together by the rod 4 prior to an indexing of the pattern card 1. The two parts 5 or 50 of the reading needle are guided in the guideways 3 or 30 affixed to not illustrated support structure. The connection between the lower part 5 of the needle and the upper part 50 consists of a helical spring 55 which is wound out of the material of the reading needle.

If the reading needle 5,50—as is shown in FIG. 1—strikes a nonperforated portion of the pattern card 1, the impact of the lower needle part 5 onto the pattern card is absorbed by the helical spring portion 55. If the reading needle 5,50 is received in a perforation, the spring 55 does not influence the needle parts 5,50.

A spiral spring or a resilient bar 57 can be utilized instead of the helical spring.

In the previously described embodiment, the reading needle does not have a damper and, as a result, vibrations can occur.

Figure 2:
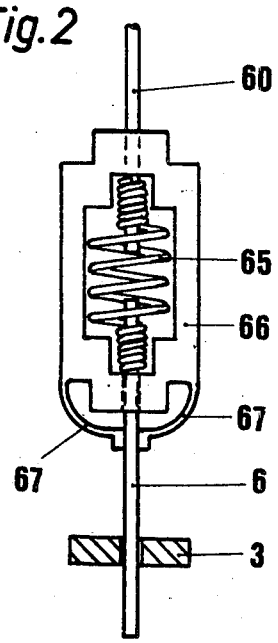
FIG. 2 illustrates a modified embodiment of the inventive arrangement.

FIG. 2 illustrates a reading needle having a damping mechanism. The reference numeral 6 identifies the lower part of the needle and the reference numeral 60 identifies the upper part of the reading needle. Both parts are connected together by a press fit type connection to the opposite ends of a helical spring 65. A cage 66 is secured to the upper part 60 of the needle and houses the spring 65 therein and is under a small amount of initial stress while the lower part 6 of the reading needle is axially movably guided in the lower part of the cage. The lower part 6 of the needle is slidably received in the guideway 3. The guideway of the upper part 60 corresponds to the structure of FIG. 1 and is not shown in FIG. 2.

A pair of flaps 67 are mounted on the lower part of the cage 66, which flaps grip around the lower part 6 of the reading needle with a small amount of applied pressure. These flaps 67 frictionally dampen any vibrations in the reading needle during contact thereof with a nonperforated part of the pattern card. The cage 66 with the flaps 67 may be made of plastic. Installation of the spring 65 into the cage substantially permits a free selection of the dimension of the spring.

Figure 3:
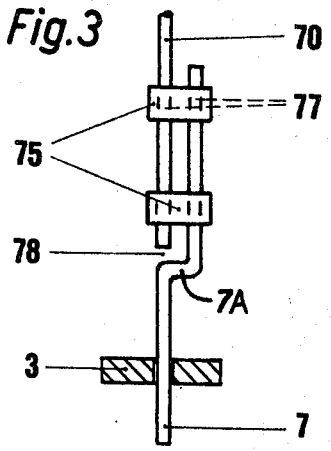
FIG. 3 illustrates a two-part reading needle, the parts of which are connected by an elastic flexible element.

According to FIG. 3, the helical spring can be replaced by at least one elastic or flexible block 75 in which is received and secured the separated upper parts 70 and lower parts 7 of the reading needle. The block material functions as the spring and the spring function can still be reinforced by the fastening points 77 for the reading needle parts being provided side-by-side due to an overlapping of the two parts 7,70 and not in an axial direction one below the other. As a result, resilience occurs not only through a compression of the material of the block 75 but also through a shearing effect in the block material.

By selectively choosing the material and the dimension of the elastic block 75, the spring characteristics thereof can be varied. The illustrated bent offset 7A in the lower needle part 7 results in the space 78 between the part 7 and the lower end of the upper needle part 70 and serves as a limitation for the reciprocal motion of the spring.

In the two further modified embodiments, the yielding element consists of an arrangement in which the reading needle is composed of two parts which move reciprocally in axial direction under friction action.

Figure 4:
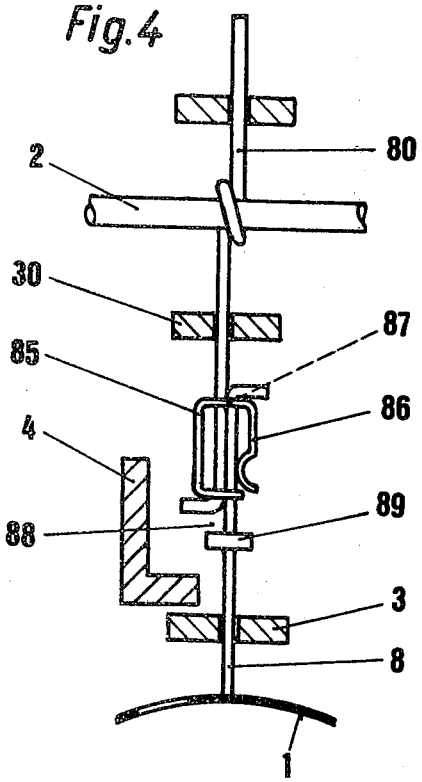
FIG. 4 illustrates a two-part reading needle, the parts of which can be moved toward one another against a frictional force.
Figure 5:
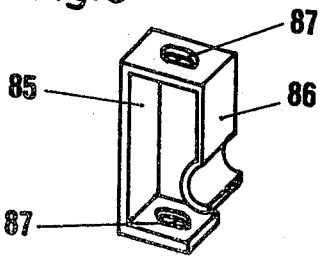
FIG. 5 is a perspective view of an auxiliary part of the connection in FIG. 4.

In FIGS. 4 and 5, the lower part of the reading needle is identified by the reference numeral 8 and the upper, independent part of the reading needle by the reference numeral 80. The lower part 8 slides in the guideway 3 and is positioned on a nonperforated portion of the pattern card 1; the upper part 80 slides in the guideway 30 and cooperates with the auxiliary needle 2 which has the part 80 wound therearound.

A clip 85 is used as the resilient element in the embodiment of FIGS. 4 and 5 and consists of spring band which is bent to a not quite closed rectangle wherein the free end 86 acts as a resilient pressure element. An opening 87 is provided in each of the upper and lower wall portions of the clip and are adapted to receive and guide the two needle parts 8,80 therein. The ends of the two needle parts 8,80 are bent and engage the outer wall portions of the upper and lower sides of the clip. Reinforced by the force of the resilient part 86, the surfaces of the needle parts frictionally engage one another within the clip 85. The reading needle is held in the illustrated position by this friction force.

During a lowering of the reading needle onto a nonperforated portion of the pattern card 1, the impact forces effect a shifting, starting at a fixed threshold frictional value of the lower needle part 8 with respect to the upper needle part 80 and causes the peak of these impact forces to be absorbed. The maximum sliding path 88 is determined by the position of a ring or collar 89 which is pressed onto the lower needle part 8. To index the pattern card, the rod 4 lifts along its path of movement toward the auxiliary needle 2 and carries therewith the entire reading needle 8,80 by engaging the bent end portion of the upper part 80 of the needle until the bent end portion of the upper end of the lower part 8 of the reading needle engages the guideway 30. A continued movement of the rod 4 will cause the lower needle part 8 to be pushed back to the original position thereof relative to the upper needle part 80 and the clip 85.

Figure 6:
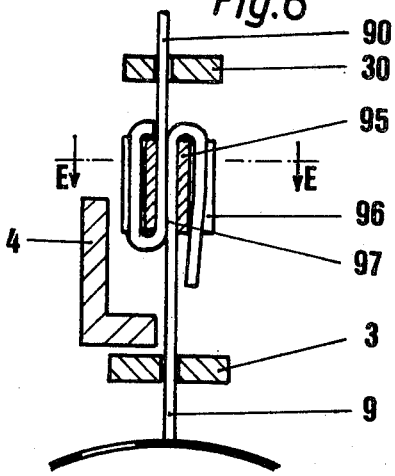
FIG. 6 is a partly cut view of a modified embodiment of a two-part reading needle.
Figure 7:
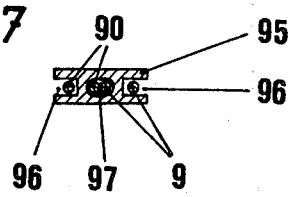
FIG. 7 is a cross-sectional view taken along the line E—E of FIG. 6.

In the modified embodiment according to FIGS. 6 and 7, the mutually adjacent ends of the needle parts 9,90 which are directed toward one another are slidably guided in an opening 97 in a block 95 and are bent backwardly generally 180° until they lie in the lateral groove 96 in the block 95 to cause the arrangement to be secured against rotation. The bent end of the upper part 90 grips around both the upper and lower ends of the block 95 so that a reciprocal relative shifting does not take place. The bent end of the lower part 9, however, can slide slightly in axial direction of the block.

When the reading needle hits a nonperforated portion of the pattern card, the lower part 9 thereof is pushed back into the block 95 at a certain relationship with respect to the impact force. During a subsequent lifting of the upper part 90 of the needle by the rod 4, a subsequent impact of the needle 9 on the guideway 30 will effect a return of the needle 9,90 to its original length.

The bent end of the lower part 9 of the reading needle rests with an initial elastic tension on the base or bottom wall of its respective groove 96. This needle end is arranged inclined with respect to the needle shaft. As a result, the frictional pressure is reinforced with an increasing shortening of the entire needle to cause a progressive braking action between the needle 9 and the block 95 when the impact force acts onto the needle 9.

With all of the described modified embodiments, the peak force from the impact of the reading needle on the nonperforated portion of the pattern card is broken due to the reading needle being shortened under the brake effect.

A further possibility of reducing these impact forces can now consist in absorbing a part of these forces by the pattern card.

For example the pattern card 1 can, in particular at the nonperforated portions, be coated with a rubber-elastic mass or a rubber-elastic layer can be arranged between the pattern card cylinder and the pattern card 1 and yields under the impact pressure. The nonperforated portions themselves can also consist directly as pins of elastic material.

A different possibility of weakening the impact pressure consists in the pattern cylinder moving during the moment of the impact of the reading needle in the same direction with same, however, at a lower speed.

The difference in movement results in a longer duration of time for transmitting the movement energy from the needle to the nonperforated portion of the pattern card to cause the peak forces to be reduced without timely influencing the reading of a perforated portion of the pattern card.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a reading arrangement for a fast-running dobby having a pattern card with perforated and nonperforated portions thereon and further having a mechanical reading device which includes a reading needle for reading said nonperforated and perforated portions of said pattern card, drive means for effecting a driving of said reading needle toward and away from said pattern card, said reading needle having a free end portion adapted to be received in said perforations, the improvement comprising wherein for the purpose of reducing the impact energy of said reading needle on said nonperforated portion of said pattern card, yieldable impact energy absorbing means is provided on said reading needle between said free end portion and the remainder of said reading needle, said yieldable impact energy absorbing means yielding in direction of the applied force of said reading needle to said pattern card to effectively reduce the overall length of said reading needle when engagement of the free end thereof with said nonperforated portion of said pattern card occurs by an amount which is equal to the length of movement of said remainder of said reading needle toward said pattern card following the engagement of said free end with said nonperforated portion so that said impact energy applied by said remainder of said reading needle to said nonperforated portion of said pattern card is absorbed to thereby enhance the life expectancy of said pattern card.

2. The improved reading arrangement according to claim 1, wherein said yieldable impact energy absorbing means includes a compressible spring integral with said reading needle and being compressible along the longitudinal axis of said reading needle.

3. The improved reading arrangement according to claim 2, wherein said compressible spring is a helical spring.

4. The improved reading arrangement according to claim 2, wherein said compressible spring is integrally formed in said reading needle just above the depth of penetration of said free end portion into said pattern card so that a small spacing will exist between said compressible spring and said pattern card when said free end portion is received in said perforated portion of said pattern card.

5. In a reading arrangement for a fast-running dobby having a pattern card with perforated and nonperforated portions thereon and further having a mechanical reading device which includes a reading needle for reading said nonperforated and perforated portions of said pattern card, the improvement comprising wherein for the purpose of reducing the impact energy of the reading needle on the pattern card, yielding means is provided which yields in direction of the applied force of said reading needle to said pattern card so that said force applied by said reading needle to said pattern card is absorbed to thereby enhance the life expectancy of said pattern card, and wherein said reading needle consists of two separate parts and wherein said yielding means is a friction connection between the ends of said separate parts of said reading needle, said friction connection yielding in an axial direction of said reading needle, one of the ends of one of said separate parts of said reading needle being movable into engagement with a portion of the other of said separate parts to limit the amount of relative movement therebetween.

6. The improved reading arrangement according to claim 5, wherein said yieldable impact energy absorbing means includes said compressible spring connected to and extending between the mutually adjacent ends of said separate parts of said reading needle.

7. The improved reading arrangement according to claim 6, wherein said yieldable impact energy absorbing means includes a cage secured to one of said ends of said two part reading needle, the other of said ends being slidably supported under a small amount of frictional resistance in said cage, said compressible spring being mounted within said cage.

8. The improved reading arrangement according to claim 5, wherein said friction connection includes at least one clip having openings therein receiving said separate parts of said reading needle therein and guiding same for relative movement, said clip having means thereon for creating a spring friction engagement with the sidewall of said separate parts.

9. The improved reading arrangement according to claim 8, wherein said mutually adjacent ends of said separate parts are coextensive and each bent to form an L-shape, one bent end of one part extending in the path of action of a lifting rod in said dobby and the other bent end of the other part extending in the path of action of a path limiting means secured to said other part.

10. The improved reading arrangement according to claim 5, wherein said separate parts are guided under friction action in an opening of an elastic block.

11. The improved reading arrangement according to claim 9, wherein said opening in said block is a central opening, said block having additionally two lateral longitudinal grooves, in each of which extends a bent end of both of said separate parts.

12. The improved reading arrangement according to claim 1, wherein said yieldable impact energy absorbing means is arranged on said reading needle just above the depth of penetration of said free end portion into said pattern card so that a small spacing will exist between said yieldable impact energy absorbing means and said pattern card when said free end portion is received in said perforated portion of said pattern card.

* * * * *

UNITED STATES PATENT AND TRADEMARK OFFICE

CERTIFICATE OF CORRECTION

PATENT NO. : 4 172 476

DATED : October 30, 1979

INVENTOR(S) : Walter Kleiner

It is certified that error appears in the above-identified patent and that said Letters Patent are hereby corrected as shown below:

Column 6, line 44; change "9" to ---10---.

Column 6, lines 48 to 55; delete in their entirety and replace with the following:

---12. The improved reading arrangement according to Claim 11, wherein one of said bent ends of one of said separate parts completely grips around said block and the other of said bent ends of the other part is elastically guided in said block.---.

Signed and Sealed this

*Nineteenth* Day of *February 1980*

[SEAL]

*Attest:*

SIDNEY A. DIAMOND

*Attesting Officer*

*Commissioner of Patents and Trademarks*